US005519587A

United States Patent [19]

Baggio et al.

[11] Patent Number: 5,519,587

[45] Date of Patent: May 21, 1996

[54] AIR PURGED PORTABLE ELECTRIC LAMP

[75] Inventors: Horacio A. Baggio; Michael A. Granat, both of Niles, Ill.

[73] Assignee: Woodhead Industries, Inc., Buffalo Grove, Ill.

[21] Appl. No.: 431,308

[22] Filed: Apr. 28, 1995

[51] Int. Cl.[6] ..... F21V 25/00

[52] U.S. Cl. ..... 362/21; 362/22; 362/267; 362/158

[58] Field of Search ..... 362/21, 22, 267, 362/310, 158

[56] References Cited

U.S. PATENT DOCUMENTS 4,276,580 6/1981 Rogers ..... 362/22
4,961,111 10/1990 Herlitz et al. ..... 362/22
5,068,720 11/1991 Herlitz et al. ..... 362/22
5,088,015 2/1992 Baggio et al. ..... 362/260

*Primary Examiner*—James C. Yeung
*Assistant Examiner*—Alfred Basichas
*Attorney, Agent, or Firm*—Emrich & Dithmar

[57] ABSTRACT

A portable electric lamp suitable for use in hazardous locations has the fixture purged with breathable air a predetermined time before power is coupled to energize the lamps. The fixture is continuously purged during operation. If the internal pressure falls below a predetermined minimum level, or exceeds a predetermined maximum during operation, power to the lamps is shut off, and the complete start cycle, including the time delay, must be undertaken before the lamps can be re-started. All leads and components are either potted or operated at an intrinsically safe power level.

4 Claims, 4 Drawing Sheets

AIR PURGED PORTABLE ELECTRIC LAMP

FIELD OF THE INVENTION

The present invention relates to portable electric lamps, and more particularly to a portable electric lamp suitable for use in hazardous locations. The term "hazardous location" is a term of art, and it is well known to those in the art. It includes operation in potentially volatile environments, such as in oil refineries, certain manufacturing locations which use solvents or other combustible materials, such as airplane manufacturing facilities, and chemical production facilities, among others.

BACKGROUND OF THE INVENTION

Portable lighting is often used in hazardous locations. In the past, incandescent lamps have been widely used in hazardous locations. However, since incandescent lamps may break during a fall, thereby exposing the heated filament and the electrical power lead, such lamps have been thought of as creating a potential for an explosion, depending upon the conditions in the environment in which they are used. Thus, attempts have been made to make incandescent lamps "explosion proof". This has required expensive and elaborate provisions for shielding, enclosing and reinforcing the enclosure for the lamps. For example, in one commercial incandescent lamp designed for use in hazardous locations, a very thick and strong globe of special explosion-proof glass surrounds the lamp, and a metal framework is placed around the globe for coupling to the base of the fixture. These units are expensive, and it is time-consuming to replace a burned-out lamp due to the construction of the unit.

It is known that fluorescent lamps are more efficient in producing light than incandescent lamps, that they operate at a much lower temperature, and that they generally have a much longer useful life. However, to provide a fluorescent lamp with an explosion-proof transparent housing such as described above for incandescent lamps is deemed prohibitive, from a manufacturing as well as a cost standpoint.

SUMMARY OF THE INVENTION

The present invention provides a portable fluorescent electrical lamp fixture including a housing which surrounds and encloses the fluorescent lamps. Power is coupled to the interior of the housing by a sheathed cord which extends through a rubber end cap. A flexible tube from a source of pressurized breathable air is also fed into the housing through the rubber end cap and coupled to a pressure regulator. Air pressure within the housing is monitored by a low pressure switch and a high pressure switch. A control circuit includes a timer circuit which commences timing when power is applied to the fixture. The pressurized breathable air is applied to the fixture at the same time. The time duration of the timer is set as a function of the air volume within the fixture, and it is of sufficient duration that approximately four times the volume of the interior of the fixture will be purged. The control circuit energizes a yellow indicator to indicate that the pressure inside the fixture has reached the predetermined minimum design level for purging. In a preferred embodiment, the control and timing circuit is provided in duplicate for redundancy to increase reliability. When the timer times out, a green indicator is energized, and power is then coupled to the lamp ballasts for energizing the lamps as line voltage.

The fixture is vented at a location remote from the inlet for the pressurized air so that purging is continuous. Air pressure is maintained within the fixture during the entire operation of the lamps. If at any time the air pressure falls below a predetermined lower level, or exceeds a higher predetermined level, power to the lamps is shut off. When power is shut off, the lamp must go through a complete start-up cycle, including the time delay, before the lamps can be re-started. Moreover, the lead-in power cables are coupled directly to the control circuit and the juncture between the lead-in cables and the control circuit, as well as the control circuit, are completely potted so that they are not exposed to even the environment within the fixture. The pressure switches and their associated leads are operated at an intrinsically safe power level, thus substantially increasing the safety of operation. The term "intrinsically safe" is also a term of art known to those skilled in this art, and as used herein, it means that a mechanical switch is operated at a power level below 0.9 milliwatts. Operation at or below this power level will prevent the occurrence of sparks.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF A PREFERRED EMBODIMENT

Figure 1:
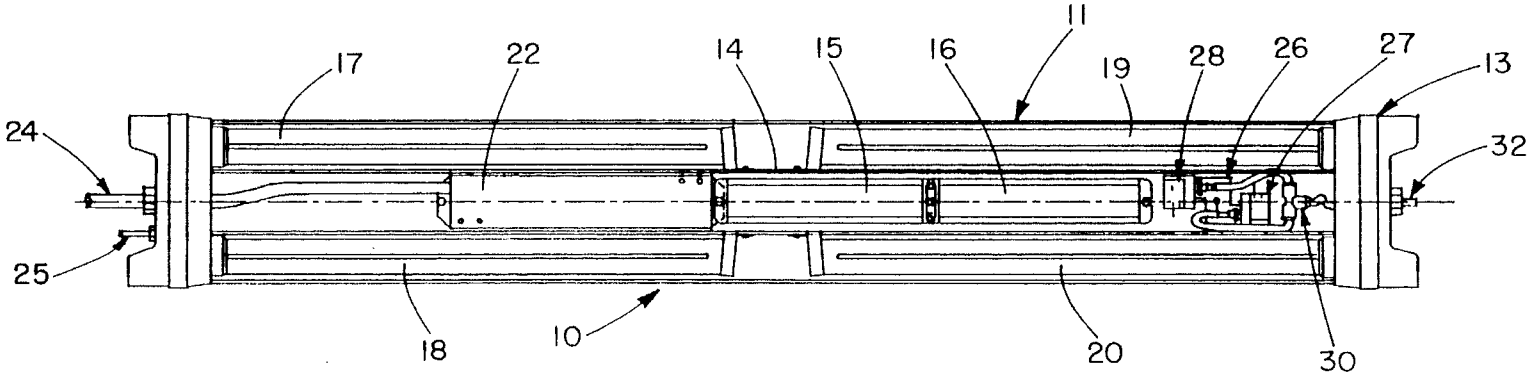
FIG. 1 is a plan view of a portable light fixture incorporating the present invention.

Referring first to FIG. 1, reference numeral 10 generally designates an air-purged portable electric fluorescent lamp fixture constructed according to the present invention. The fixture 10 includes a transparent housing 11 with its ends received in left and right end caps 12, 13. The fixture also includes a frame 14 on which first and second ballasts 15, 16 are mounted. The ballast 15 is used to energize a first pair of fluorescent lamps 17, 18; and the ballast 16 energizes a second pair of fluorescent lamps 19, 20. Further details of the mechanical mounting of the ballasts and lamps, as well as the structure of the frame 14 and its mounting within the end caps 12, 13, can be found in my U.S. Pat. No. 5,088,015, "PORTABLE FLUORESCENT LAMP FIXTURE", the disclosure of which is incorporated herein by reference.

Still referring to FIG. 1, a metal housing 22 is mounted to the frame 14 for enclosing the control circuitry which, as mentioned, is potted in conventional epoxy pottery compound for hermetically sealing the circuit elements. An electrical power cord 24 extends from the line or other source of electricity, through the end cap 12 as will be described in connection with FIGS. 2 and 3, and fed into the fixture and to the housing 22.

A tube 25 serves as a conduit for pressurized breathable air from a source into the interior of the fixture 10, as also better seen and described in connection with FIG. 3.

A mounting bracket 26 is mounted to the frame 14; and a high pressure switch 27 and a low pressure switch 28 are mounted to the bracket 26. The pressure switches 27, 28 are referenced against atmospheric pressure by means of a pair of tubes coupled to a T-fitting 30, the third port of which is in communication with the atmosphere by means of a tube 32 which passes through end cap 13 and is mounted in such as way as to be sealed to that end cap. The interior of the fixture is also vented to the atmosphere through end cap 13.

Figure 2:
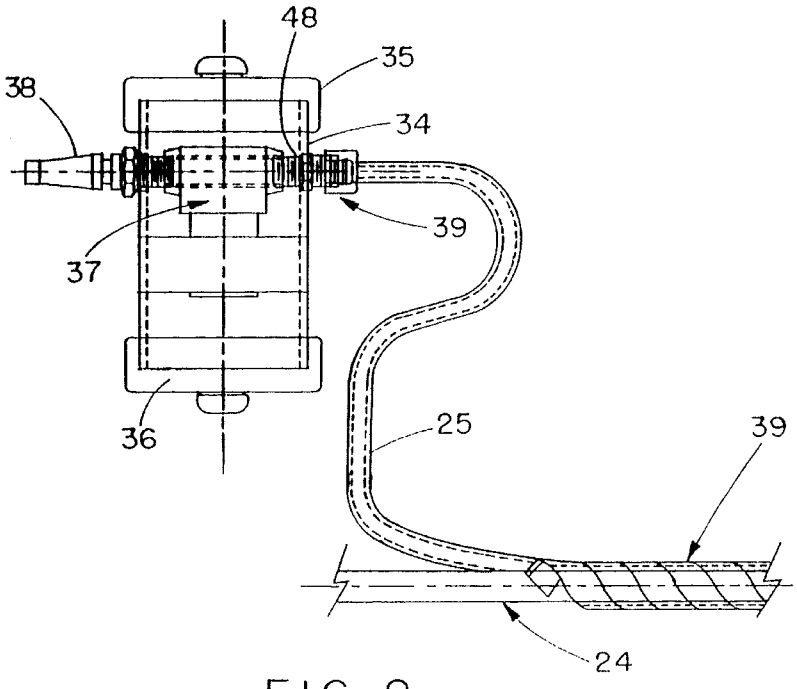
FIG. 2 is a side view of a pressure regulator for the fixture of FIG. 1.

Referring now to FIG. 2, a tubular housing 34 is provided with a top cap 35 and a bottom cap 36 to form an enclosure for a conventional pressure regulator 37. Pressurized air from a source (not shown) supplied by the user is fed to the input of the regulator 37 by means of an adapter/connector 38. The output of pressure regulator 48 is coupled to the air conduit 25 by means of a coupling 39.

Figure 3:
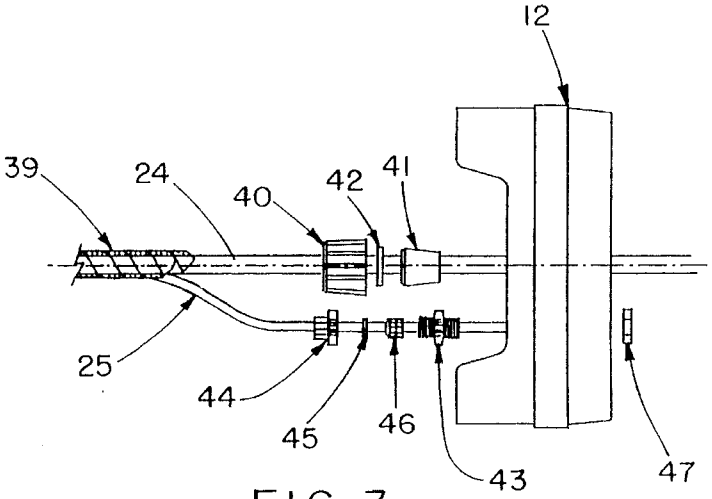
FIG. 3 is a close-up view of the left end cap of FIG. 1 showing the connection of the electrical power cord and the inlet air conduit coupled to the fixture.

Turning now to FIG. 3, the air inlet tube 25 may be routed with the electrical cord 24, protected by a spiral plastic wrapping 29. Adjacent the end cap 12, the tube 25 is separated from the electrical cord 24 and fed separately through the end cap 12. The electrical cord 24 is secured with an air-tight coupling to the end cap 12 by means of a threaded nipple molded in end cap 12. A threaded lock nut 40 secures a tapered grommet 41 and a nylon washer 42 to the threaded nipple to secure the cord 24. The air tube 25 is also connected to the end cap 12 by means of a double-threaded nipple 43 which is secured and sealed by means of a lock nut 44, washer 45 and grommet 46. A lock nut 47 then secures the right side of the threaded nipple 43 to the end cap 12.

Similarly, the tubing or conduit 25 passes through the end cap 12 and is mounted on a double-threaded nipple 40, bushing 41, washer 42 and lock nut 43.

Figure 4:
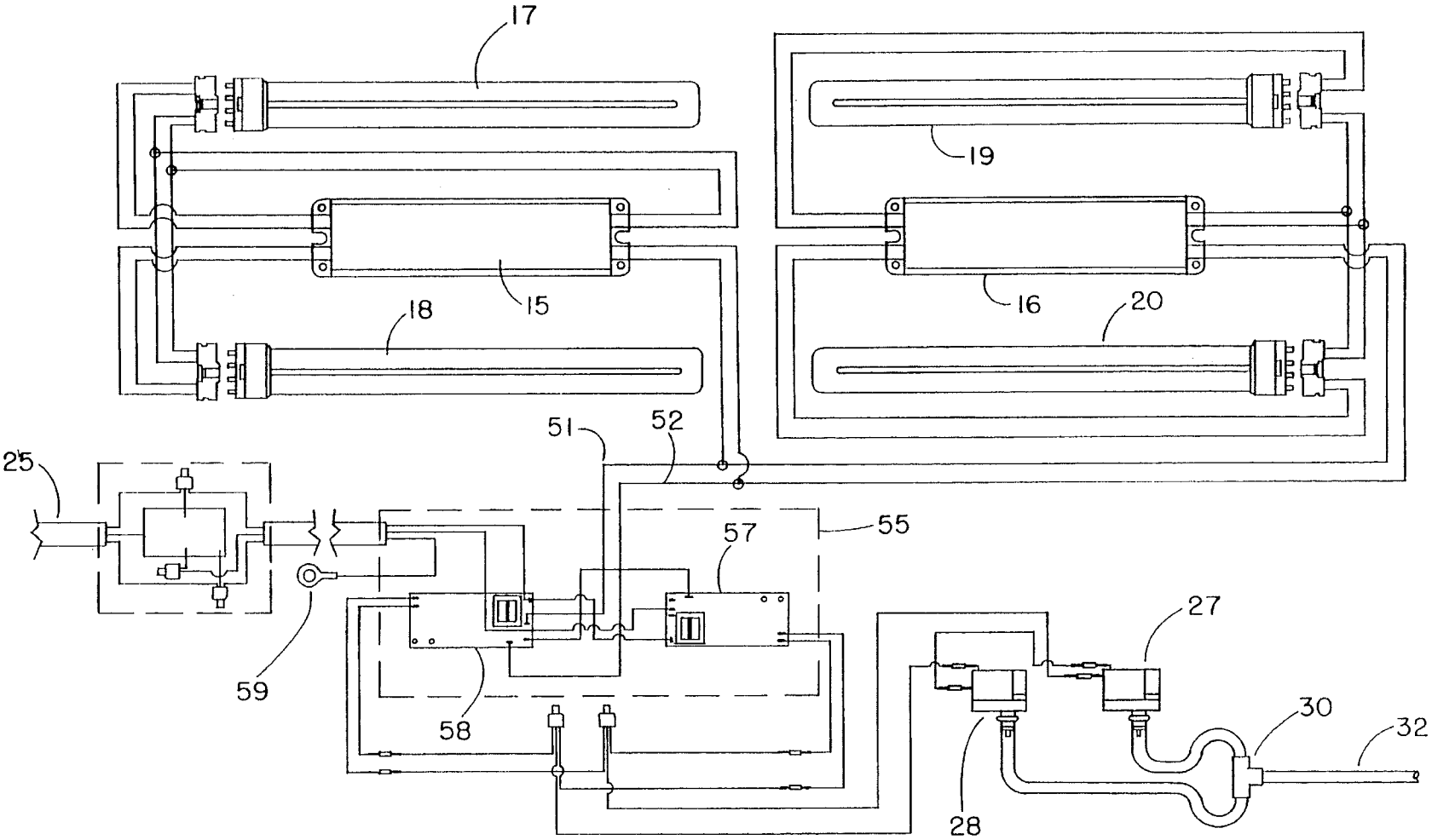
FIG. 4 is an electrical schematic diagram of the power and control circuitry of the fixture of FIG. 1.

Turning now to FIG. 4, the ballasts 15, 16 and the fluorescent lamps 17–20 are shown connected in a conventional electrical circuit fed by input leads 51, 52 from the control circuit which is shown in FIG. 4 as included within the dashed block 55. The dashed block 55 also shows those circuit elements and components which are embedded in a potting compound for safety reasons and housed in housing 22. Included within the potted material are first and second timer circuits generally designated 57 and 58 respectively. The timer circuits 57, 58, which will be further discussed below, may be identical. They are connected in redundant circuit, however, to provide for greater reliability. Further, a conventional surge suppression circuit may be included to reduce transients in the input power leads.

Each timer circuit 57, 58 has seven terminals designated respectively X1 through X7. The negative lead from the input power cord 25 is connected to the X1 terminal of the timer circuit boards 57, 58; and the positive power lead from the input power cord 25 is connected to the X2 terminal of the timer circuits 57, 58. The ground lead from the input power cord is connected to a ground terminal 59 which is connected by means of a screw to the frame 14. FIG. 4 also illustrates the electrical connections between the terminals X6, X7 of the timer circuits 57, 58 and the high pressure switch 27 and low pressure switch 28, previously described. Each of the pressure switches 27, 28 has a common terminal, a normally closed terminal and a normally open terminal.

Figure 5:
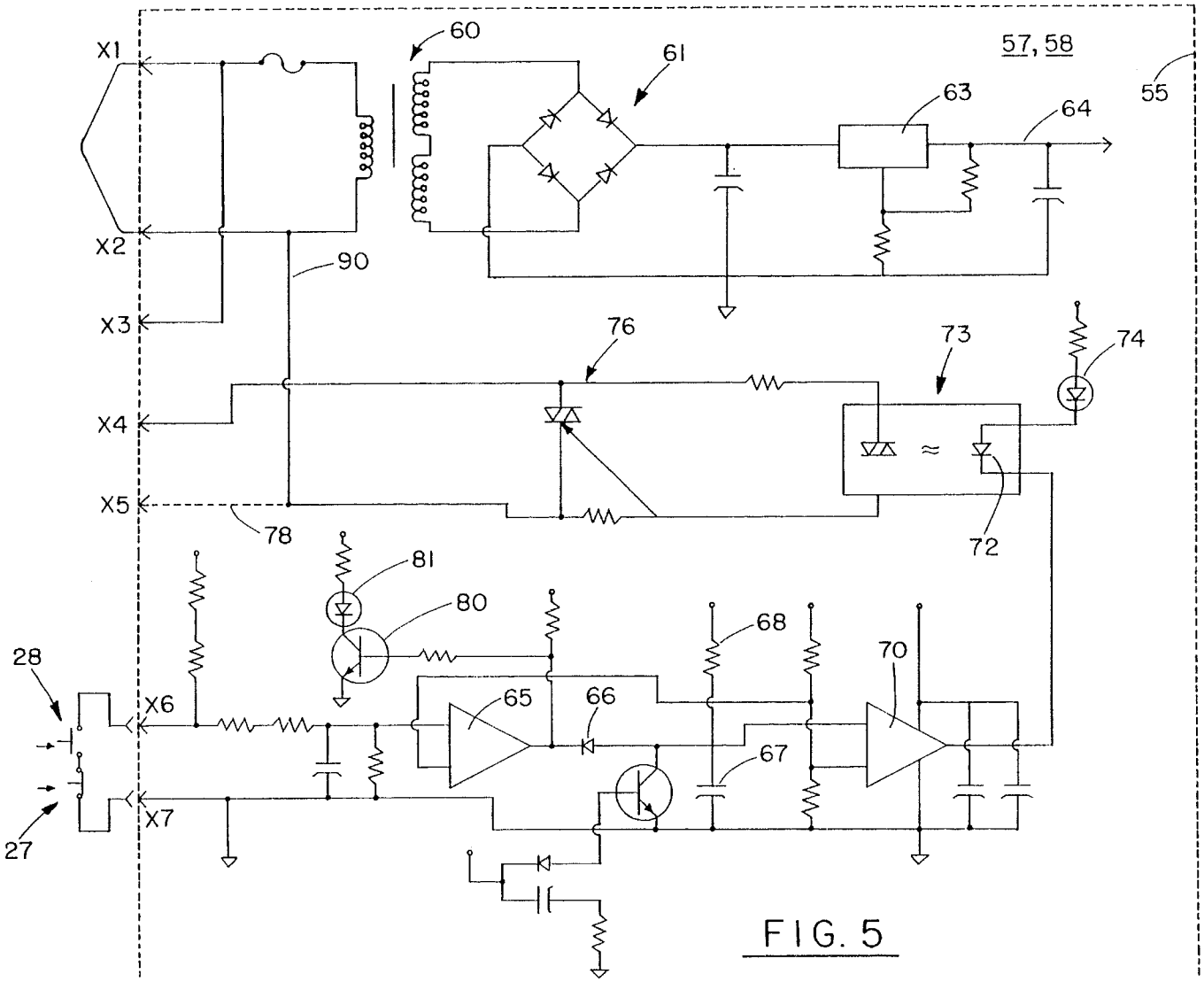
FIG. 5 is a circuit schematic diagram of the control circuitry for the fixture of FIG. 1.

A more detailed circuit schematic of the control timer circuits 57, 58 is shown in FIG. 5.

The input power is fed to a transformer 60 and thence to a diode bridge 61, the output of which feeds a conventional, commercially-available voltage regulator circuit 63. The output of the voltage regulator circuit 63 is a regulated DC voltage which supplies the $B^+$ voltage for the remainder of the logic circuitry to be described.

Turning now to the lower left-hand portion of the schematic diagram of FIG. 5, the normally open contacts of the low pressure switch 28 are connected in series with the normally closed contacts of the high pressure switch 27 when only a single control circuit is used. For redundant control circuits, the connections are described below. In FIG. 5, then, the two switches are connected in series between terminals X6 and X7 of the control circuit. Output terminal X6 is connected through a voltage divider network to the negative input of a comparator circuit 65. The output of the comparator 65 is coupled through a diode 66 to the junction between a capacitor 67 and a resistor 68.

When pressurized breathable air is first transmitted into the housing the fixture 10, the normally opened contacts of the low pressure switch 28 are open, as shown in FIG. 5. The output of the comparator circuit is a low voltage which clamps the positive terminal of capacitor 67 to a low voltage. When the pressure inside the housing reaches the first predetermined low pressure level (typically around 2.0 in. Hg.), the contacts 28 close and cause the output of comparator 65 to go positive. This permits the positive terminal of capacitor 67 to charge through resistor 68. The values of capacitor 67 and resistor 68 are selected to allow a charging time of approximately two minutes.

The junction between the capacitor 67 and resistor 68 is connected to the one input of a second comparator circuit 70. When the charging voltage at the two minute interval reaches the design level, as determined by the resistive voltage divider coupled to the other input of the comparator 70, the output of the comparator 70 goes to a low voltage, thereby energizing an LED 72 of an optical coupler generally designated 73, as well as an indicator LED 74. The optical coupler is connected in the gate circuit of a switching Triac 76 (or other semi-conductor power switch) which then conducts, and establishes electrical continuity between the terminals X4 and X5 of the control circuit. In the case where only a single circuit board is employed for the control circuit, a connection must be added as indicated by the dashed line 78, and the switching of the Triac 76 thereupon causes power to be coupled from the leads X1, X2 to the leads X3 and X4 respectively, thereby coupling power to the ballasts to excite the lamps.

When the low voltage switch 28 closes, as the lower pressure threshold is reached, and the output of comparator 65 goes high, it also causes a transistor 80 to conduct, which in turn causes a yellow LED indicator 81 to become illuminated, thereby signalling to a user that the interior of the housing is under pressure and that the pressure has exceeded the low pressure threshold level.

The LED indicator 81 may be yellow so as to indicate, when it is illuminated, a "stand-by" condition; whereas the LED indicator 74 may be green to indicate, when it is illuminated, that power is applied to the lamp circuits.

If the pressure at any time exceeds the high pressure level (5.0 in. Hg. in the illustrated embodiment), the normally closed contacts of the high pressure switch 27 open, reversing the state of comparator 65, and causing capacitor 67 to discharge immediately. This disables the optical coupler 73 and causes the Triac 76 to become non-conducting, and thereby shuts off power to the ballasts immediately. Once the high pressure threshold has been exceeded, a full restarting cycle must be completed before power is again coupled to the lamps. This allows the user to check the vent which discharges to the ambient to be checked.

All of the circuitry enclosed within the dashed line 55 of FIG. 5 may be mounted on a single circuit board and embedded in an epoxy resin, including the sheath of the power cord 25. The switches 27 and 28 are selected, and the voltage levels on the lines leading to the switches 27 and 28 are designed such that the intrinsically-safe level of power defined above is not exceeded in the pressure switches 27, 28 and their associated leads. Thus, the circuit qualifies as an intrinsically safe circuit because the only power coupled to components not encased in epoxy is at an intrinsically safe level until the purging cycle is complete. Once the purging cycle is complete, there is no hazard, of course.

Figure 6:
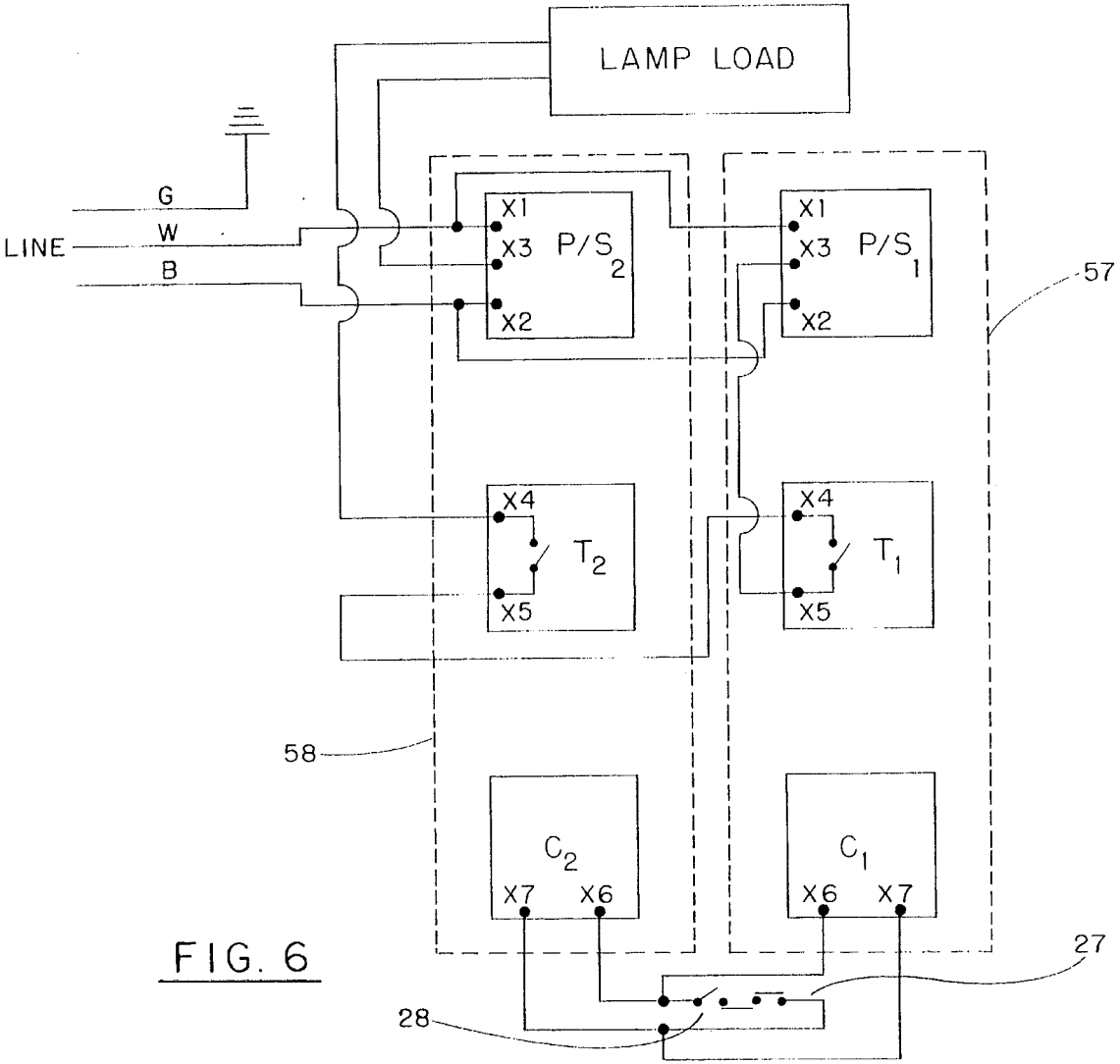
FIG. 6 is an electrical schematic diagram illustrating the interconnection of redundant control circuits for a preferred embodiment of the invention.

Turning now to FIG. 6, there is shown a schematic diagram illustrating how two control circuit boards, 57, 58, each individual board including the circuitry shown in FIG. 5, may be wired together externally to provide a redundant control circuit. Again, a conventional surge suppression circuit may be employed. The input power leads are connected to both input terminals X1 and X2 respectively. The X3 and X4 inputs of the circuit board 58 are coupled to the lamp load for the circuit board 58, and the X3 lead of circuit board 57 is coupled to terminal X5 of circuit board 57. The terminal X4 of circuit board 57 is connected to the terminal X5 of circuit board 58, and the terminals X6 and X7 are connected directly together, as illustrated in FIG. 6. Only one set of pressure switches is used and they are designated respectively 27 and 28 in accordance with the above disclosure. This arrangement also calls for the removal of a trace of copper to disconnect terminal X2 from the cathode of the Triac 76 (represented by opening the lead 90 in FIG. 5), and the addition of jumper wire illustrated at 91 in FIG. 5 between the terminal X3 and the terminal X5 of control circuit 57. This arrangement thus places the Triacs in series circuit, and the timer circuits in parallel, while leaving the switch arrangement the same. In operation, the redundant control circuit arrangement is similar to that described above in connection with FIG. 5 except that when the normally open switch 28 closes, both timer circuits time out simultaneously to the two minute interval and then switch their associated comparators 70, causing Triacs 76 to conduct.

Having thus disclosed in detail a preferred embodiment of the invention, persons skilled in the art will be able to modify certain of the circuitry or structure which has been illustrated and to substitute equivalent elements for those which have been disclosed, while continuing to practice the principle of the invention; and it is, therefore, intended that all such modifications and substitutions be covered as they are embraced within the spirit and scope of the appended claims.

We claim:

1. A portable electric lamp suitable for operation in hazardous locations comprising: a housing capable of being transported and including a light-transmissive wall portion; a lamp circuit including a source of light in said housing; electrical power leads for coupling power into said housing; a conduit for transmitting air under pressure into said housing; a first pressure sensing switch for sensing a first predetermined pressure in said housing; a second pressure sensing switch for sensing a second predetermined pressure in said housing, said second predetermined pressure being higher than said first predetermined pressure, said first and second pressures defining a desired operating range of pressure within said housing for continuously purging the air therein; and a first control circuit responsive to the actuation of said first pressure sensing switch indicating that the pressure within said housing has reached said first predetermined pressure, said control circuit including a timing circuit for delaying a predetermined delay time, said control circuit actuating a switch circuit after said delay time to couple electrical power from said electrical power leads to said lamp circuit, said second pressure switch being responsive to the pressure within said housing reaching a second predetermined level to de-actuate said switch circuit when said second predetermined pressure is exceeded.

2. The apparatus of claim 1 including a second control circuit coupled in redundant circuit with said first control circuit whereby when the associated timer circuit time out it actuates its associated switch circuits, said switch circuits being connected in series.

3. The apparatus of claim 2 characterized in that said first and second control circuits and the connecting ends of said electrical power leads within said housing are embedded in a potting compound for hermetically sealing the same and further characterized in that said first and second pressure sensing switches operate at intrinsically safe power levels.

4. The apparatus of claim 1 further including an indicator light emitting light of a first color responsive to the actuation of said low pressure switch for indicating that said circuit is within the desired pressure range; and a second indicator light emitting light of a second color and actuated when the associated switch circuit is actuated to indicate power coupled to said associated lamp circuit.

* * * * *